US006948974B2

(12) United States Patent
Tashiro et al.

(10) Patent No.: US 6,948,974 B2
(45) Date of Patent: Sep. 27, 2005

(54) END-PROCESSING STRUCTURE OF FLAT CABLE AND METHOD OF END-PROCESSING OF FLAT CABLE

(75) Inventors: Harunori Tashiro, Haibara-gun (JP); Masaru Fukuda, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/706,283

(22) Filed: Nov. 13, 2003

(65) Prior Publication Data

US 2004/0248456 A1 Dec. 9, 2004

(30) Foreign Application Priority Data

Nov. 14, 2002 (JP) ..... P.2002-331159

(51) Int. Cl.[7] ..... H01R 4/24
(52) U.S. Cl. ..... 439/496
(58) Field of Search ..... 439/404, 405, 439/417, 495, 496, 499

(56) References Cited

U.S. PATENT DOCUMENTS

| | | | | |
|---|---|---|---|---|
| 3,082,398 A | * | 3/1963 | Valach | 439/496 |
| 3,355,699 A | * | 11/1967 | Oshva | 439/412 |
| 6,280,241 B2 | * | 8/2001 | Herlinger et al. | 439/496 |
| 6,305,970 B1 | * | 10/2001 | Nagai et al. | 439/495 |

FOREIGN PATENT DOCUMENTS

| | | |
|---|---|---|
| EP | 0 168 048 A2 | 1/1986 |
| JP | 06-314575 A | 11/1994 |
| JP | 08-124612 A | 5/1996 |
| JP | 10-247529 A | 9/1998 |
| JP | 2002-223513 A | 8/2002 |

* cited by examiner

*Primary Examiner*—Renee Luebke
(74) *Attorney, Agent, or Firm*—Sughrue Mion, PLLC

(57) ABSTRACT

An end-processing structure of a flat cable includes a flat cable, a connector housing, a plurality of pressure terminal fittings, respectively having press-contacting blades, and mounted in the housing and a cover attached to the housing to cover a press-contacting part of the flat cable which is press contacted with the press-contacting blades. The flat cable includes a plurality of sheathed conductors, each conductor covered with an insulative sheath and a plurality of connecting portions interconnecting the parallel sheathed conductors. The flat cable has an interconnecting part in which the conductors are interconnected with the connecting portions and a press-contacting part in which the conductors are separated from each other. First and second interconnecting parts extending from the press-contacting part are folded back from first and second sides of the cover, respectively. The first interconnecting part of the flat cable is then superposed on the second interconnecting part of the flat cable and secured by a binding member.

4 Claims, 9 Drawing Sheets

PRIOR ART

END-PROCESSING STRUCTURE OF FLAT CABLE AND METHOD OF END-PROCESSING OF FLAT CABLE

BACKGROUND OF THE INVENTION

This invention relates to a flat cable end-processing structure and a flat cable end-processing method for the purpose of attaching a press-contacting connector to an end portion of a flat cable including a plurality of juxtaposed conductors each covered with an insulating sheath.

When a flat cable, including a plurality of juxtaposed conductors each covered with an insulating sheath, is connected to an electrical equipment or the like to form a circuit member, it is a common practice to cut an elongated flat cable into a desired length and to use it.

In the case of connecting a flat cable FD to an electrical equipment or the like as shown in FIG. 9, one may use, for example, a press-contacting connector 110 which is attached to an end portion of the flat cable FD (see, for example, JP-A-2002-223513 (Pages 2 and 3, FIG. 1).

The press-contacting connector 110 includes a connector body (connector housing) 111 for receiving a plurality of press-contacting terminals (not shown), and a retainer member (cover) 112 covering a rear end face of the connector body 111.

Insulated conductors D of the flat cable FD, press-contacted with press-contacting blades of the press-contacting terminals projecting from the rear end face of the connector body 111, are fixedly held by the retainer member 112 in such a manner that each of the insulated conductors D is bent at right angles. The insulated conductors D are cut such that cut end faces 113*a* and 113*b* of these conductors are arranged in a staggered manner, and with this arrangement a creeping distance between the adjacent conductors is increased so that a leakage current is less likely to flow.

In recent years, with a compact design of electrical equipments and the like, press-contacting connectors for connection to a flat cable have been formed into a compact design, and press-contacting blades of press-contacting terminals for being received in such a press-contacting connector have also been formed into a smaller size, and the pitch of the press-contacting blades has been precisely set.

When attaching the press-contacting connector to the flat cable, the flat cable is held and fixed against movement by a pair of wire holders located respectively at front and rear sides (spaced from each other in the longitudinal direction) of a press-contacting portion of the flat cable where the insulated conductors are positioned at a predetermined pitch, and then the press-contacting operation is effected.

However, when the press-contacting connector is thus attached to the end portion of the flat cable a problem exists in that an extra portion for holding and fixing purposes is formed at the end portion of the flat cable. There is a possibility that such an undesirable extra portion causes the flow of a leakage current or the short-circuiting between the conductors. Therefore, one approach is to remove the extra portion by cutting it subsequent to the press-contacting operation, but this approach is undesirable because an additional step of cutting the extra portion is added. Thus, the efficiency of the operation is lowered, and the cost of installation increases.

When a pulling force acts on the flat cable, the press-contacting blades of the press-contacting terminals, formed into a smaller size as a result of the compact design of the press-contacting connector, are subject to being affected at the press-contacted portions by this force. Therefore, the fixing or holding of the flat cable only by the cover is not sufficient, and the press-contacting connector, in some cases, fails to exhibit a sufficient strength to withstand the pulling load acting on the flat cable.

SUMMARY OF THE INVENTION

It is therefore an object of the present invention to provide a flat cable end-processing structure and a flat cable end-processing method, in which the leakage of a current is prevented at an end portion of a flat cable, and also a sufficient strength to withstand a pulling load is secured at this end portion.

In order to achieve the above object, according to the present invention, there is provided an end-processing structure of a flat cable comprising a flat cable, a plurality of sheathed conductors, a plurality of connecting portions, a connector housing, a plurality of pressure terminal fittings, and a cover.

The end-processing structure is further defined by the flat cable including a plurality of sheathed conductors, wherein each conductor is covered with an insulative sheath. Also, the plurality of connecting portions are interconnecting the sheathed conductors arranged in parallel, wherein the flat cable has an interconnecting part in which the sheathed conductors are interconnected with the connecting portions, and a press-contacting part in which the sheathed conductors are separated with each other. Further, the plurality of pressure terminal fittings respectively have press-contacting blades and are mounted in the connector housing. Additionally, the cover is attached to the connector housing to cover the press-contacting part of the flat cable which is press contacted with the press-contacting blades.

Furthermore, the end process structure includes a first interconnecting part extended from the press-contacting part and having end faces of a distal end portion of the flat cable is folded back from a first side of the cover along an outer face of the cover and a second interconnecting part extended from the press-contacting part is folded back from a second side of the cover along the outer face of the cover. Moreover, the first interconnecting part of the flat cable is superposed on the second interconnecting part of the flat cable and a superposed portion of the first and second interconnecting parts are wound so as to surround the end faces of the distal end portion to insulate the end faces from an exterior by a binding member.

Preferably, the cover has a pressing member which press the press-contacting part of the flat cable press-contacted with the press-contacting blades in a state that the cover is attached to the connector housing.

Preferably, a guiding member is formed on the outer face of the cover so as to guide the flat cable which is folded back from the cover along the outer face of the cover.

According to the present invention, there is also provided a method of end-processing of a flat cable, comprising the steps of:

providing a flat cable which includes a plurality of sheathed conductors, each conductor being covered with an insulative sheath, and the sheathed conductors arranged in parallel being interconnected with each other by a plurality of connecting portions;

providing a connector housing;

providing a plurality of pressure terminal fittings, respectively having press-contacting blades, and mounted in the connector housing;

providing a cover;

cutting the connecting portions of the flat cable so as to form a press-contacting part in which the sheathed conductors are separated with each other;

press-contacting the press-contacting part of the flat cable to the press-contacting blades;

attaching the cover to the connector housing to cover the press-contacting part of the flat cable which is press contacted with the press-contacting blades;

drawing out a first interconnecting part of the flat cable extended to the press-contacting part and having end faces of a distal end portion of the flat cable from a first side of the cover along an outer face of the cover;

drawing out a second interconnecting part of the flat cable extended to the press-contacting part from a second side of the cover along the outer face of the cover;

superposing the first interconnecting part of the flat cable on the second interconnecting part of the flat cable; and binding a superposed portion of the flat cable so as to surround the end faces of the distal end portion to insulate the end faces from an exterior by a binding member.

In the above end-processing structure and method for processing the flat cable end, the distal end portion (where the insulated conductors are held at the predetermined intervals by the connecting portions) and the press-contacting part (where the connecting portions are removed by cutting in the longitudinal direction over the predetermined range, so that the distance between the adjacent insulated conductors can be adjusted in the direction of the width) are formed at the distal end portion of the flat cable where the plurality of insulated conductors are interconnected in parallel relation to one another by the connecting portions.

When the press-contacting portion of the flat cable is to be press-contacted with the press-contacting blades of the press-contacting terminal fittings mounted in the connector housing, the first interconnecting part and the second interconnecting part of the flat cable, disposed respectively at the front and rear sides (spaced from each other in the longitudinal direction) of the press-contacting part, are fixedly held against movement, and also the distance between the adjacent insulated conductors of the press-contacting part can be adjusted in the direction of the width, and therefore the insulated conductors are accurately positioned in accordance with the highly-precise pitch of the press-contacting blades, and are positively press-contacted with these press-contacting blades.

Then, the cover is attached to the connector housing to cover the press-contacting part for the press-contacting blades, so that the insulated conductors are fixedly held between the cover and the connector housing. Thereafter, the distal end portion (which is an extra portion) of the first interconnecting part is folded back to be superposed on the second interconnecting part of the flat cable in such a manner that the end portion of the flat cable is extended along the outer face of the cover. In this condition, the binding member is wound on the superposed portions to surround the end faces of the distal end portion to insulate these end faces from the exterior.

Thus, the distal end portion (which is the extra portion) is folded back to be superposed on the central-side portion of the flat cable, and the superposed portions are bound by the binding member, so that the distal end portion is prevented from fluttering.

The end faces of the distal end portion are covered with the wound binding member, and are insulated from the exterior, and besides the insulated conductors at the distal end portion are held at the predetermined intervals by the insulating interconnecting portions. Therefore, the end faces of the adjacent conductors will not be accidentally moved toward each other, and therefore the current leakage and the short-circuiting are positively prevented.

Further, the distal end portion (which is the extra portion) is folded back to be superposed on the central-side portion of the flat cable in such a manner that the end portion of the flat cable is extended along the outer face of the cover, and then these superposed portions are bound by the binding member. By doing so, the end portion of the flat cable is fixed to the outer face of the cover in intimately-contacted relation thereto, and therefore even when a pulling force acts on the flat cable, the press-contacted portions are less liable to be affected by this force.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of a flat cable end-processing structure of the present invention, as well as one preferred embodiment of a flat cable end-processing method of the invention, will now be described in detail with reference to the accompanying drawings.

Figure 1:
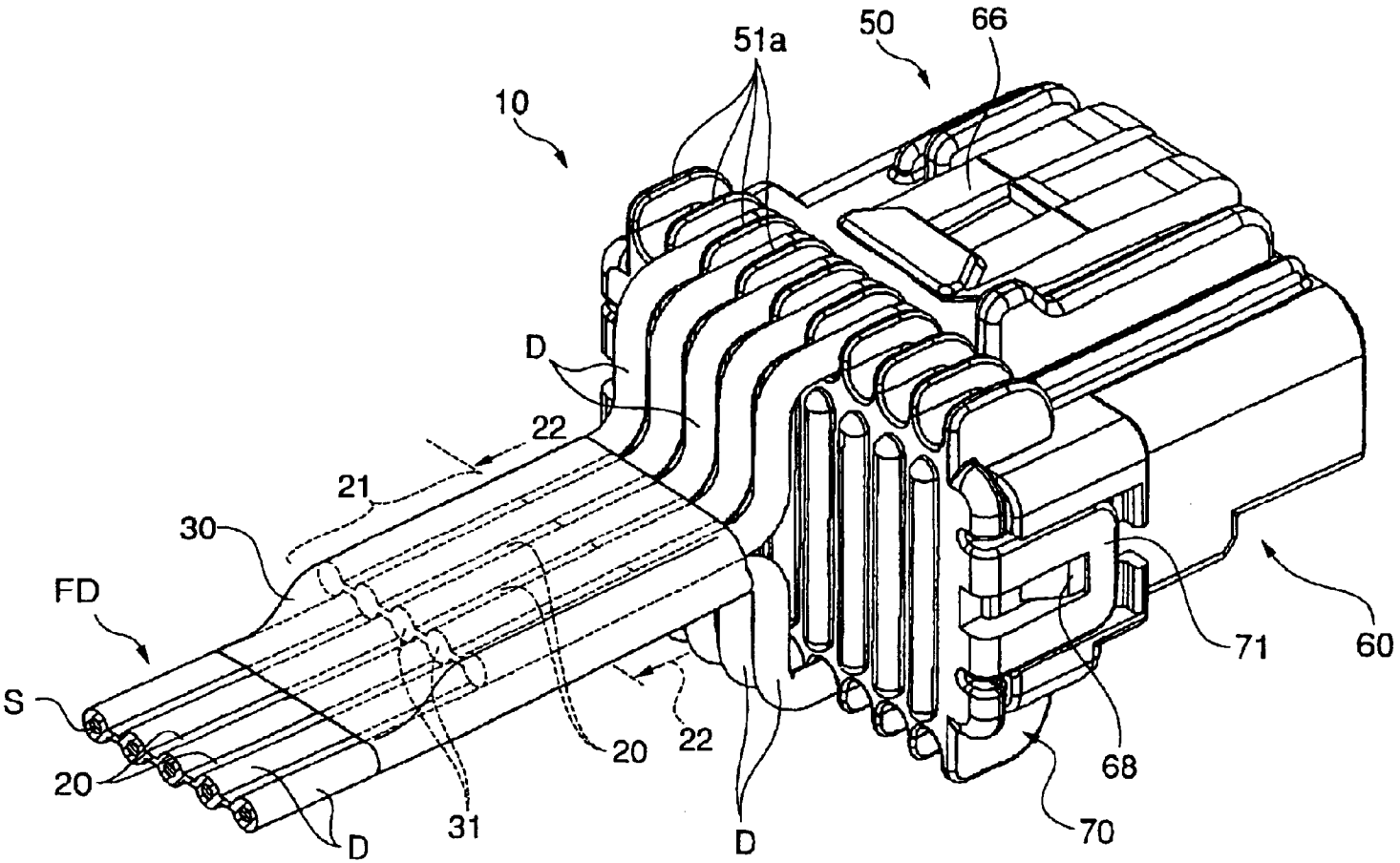
FIG. 1 is a perspective view of one preferred embodiment of a flat cable end-processing structure of the invention as seen from the rear side.
Figure 2:
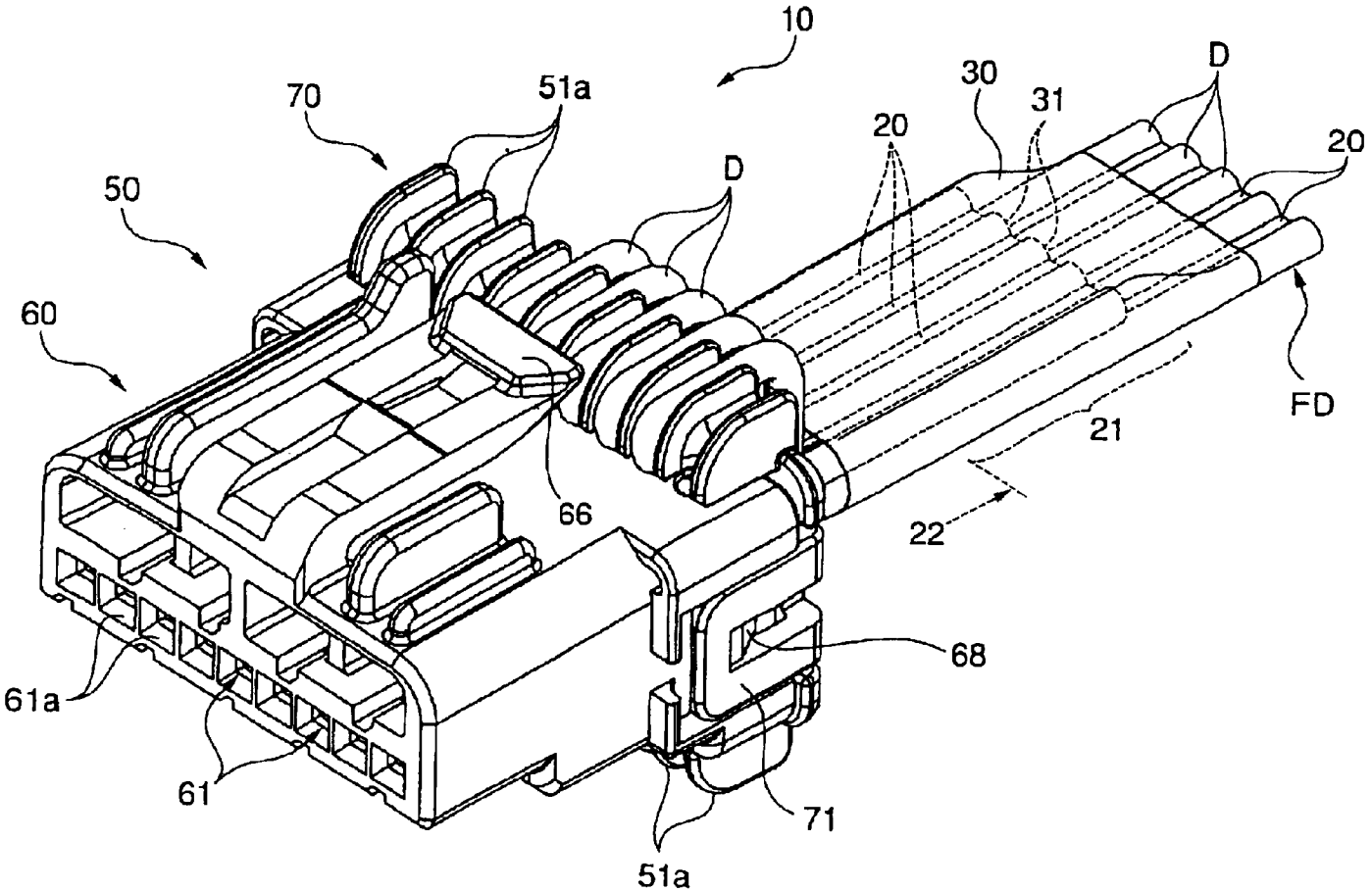
FIG. 2 is a perspective view of the flat cable end-processing structure of FIG. 1 as seen from the front side.

FIG. 1 is a perspective view of one preferred embodiment of the flat cable end-processing structure of the invention as seen from the rear side, and FIG. 2 is a perspective view of this structure as seen from the front side.

As shown in FIGS. 1 and 2, the flat cable end-processing structure 10 of the invention is used for attaching a press-contacting connector 50 to an end portion of a flat cable FD including a plurality of juxtaposed conductors S each covered with an insulating sheath.

Figure 6:
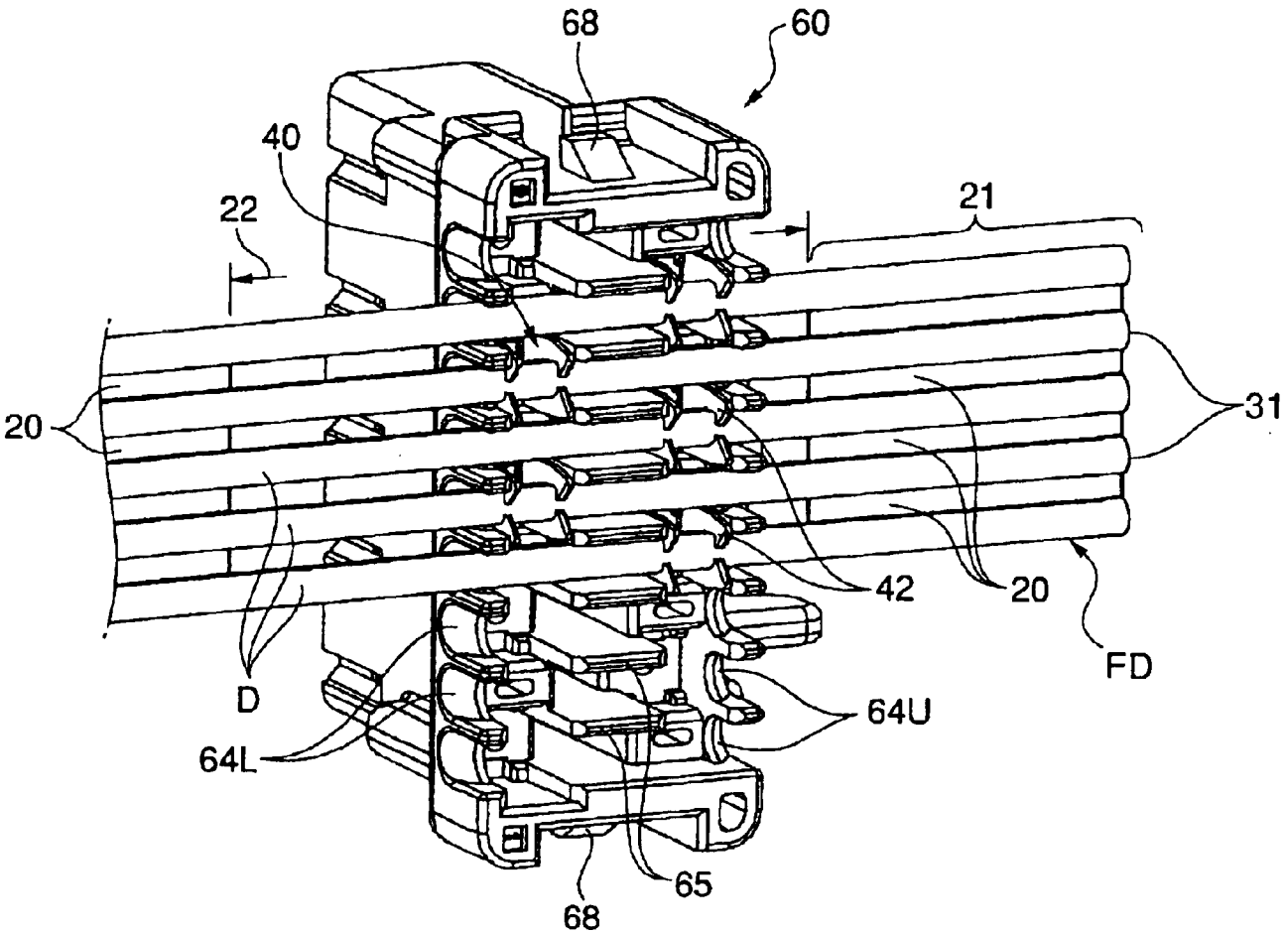
FIG. 6 is a perspective view showing a condition in which a flat cable is press-contacted with a connector housing.

Insulating interconnecting portions 20 are cut away from the end portion of the flat cable FD over a predetermined range except a distal end portion 21 of the flat cable, thereby forming a press-contacting portion 22 at the end portion of the flat cable, and the distance between any two adjacent insulated conductors D at the press-contacting portion 22 can be adjusted in a direction of a width of the flat cable (see FIG. 6).

Figure 3:
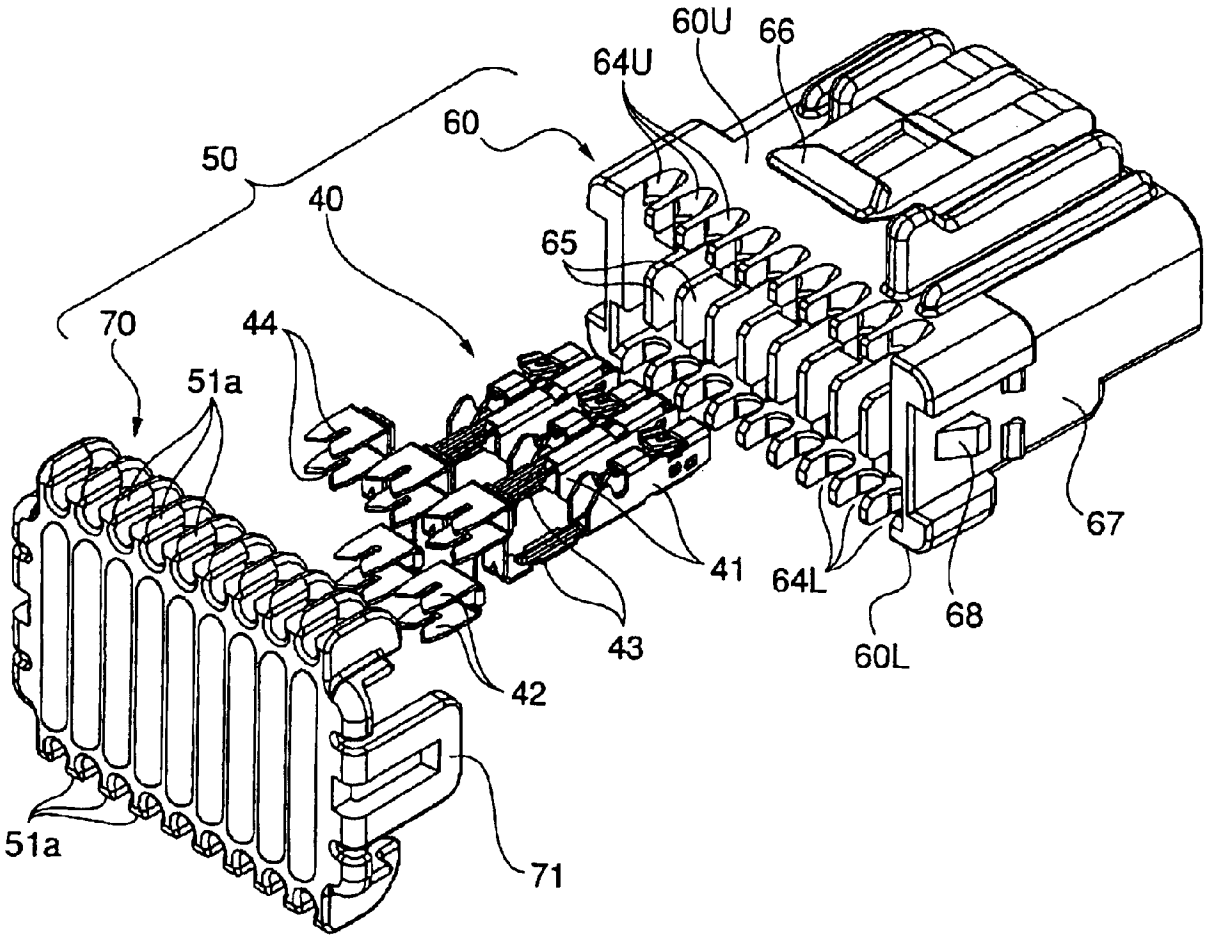
FIG. 3 is an exploded, perspective view of a press-contacting connector shown in FIG. 1.
Figure 4:
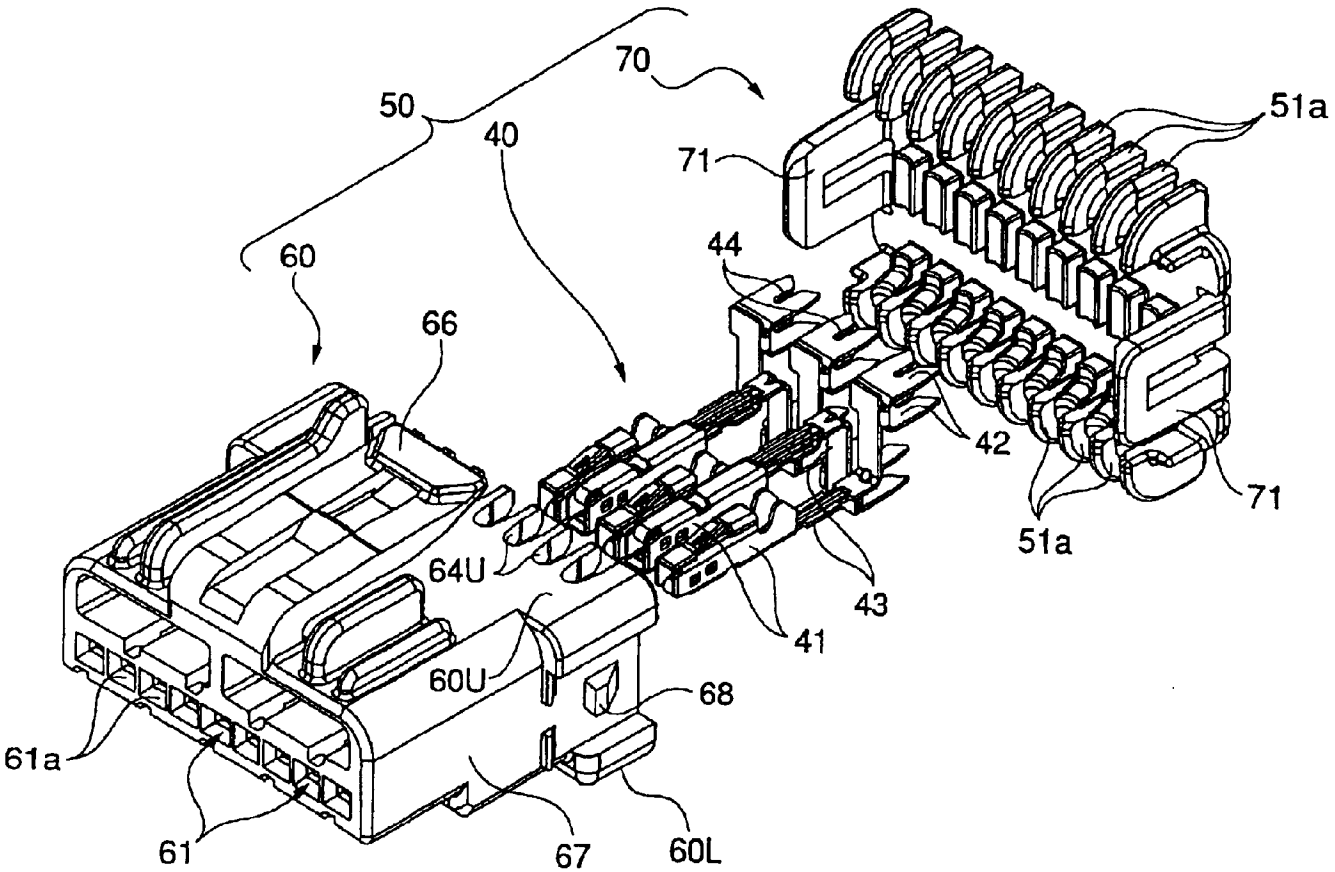
FIG. 4 is an exploded, perspective view of the press-contacting connector of FIG. 2.

As shown in FIGS. 3 and 4, the press-contacting connector 50 includes a connector housing 60 for receiving a plurality of press-contacting terminal fittings 40 (each having press-contacting blades 42) in a juxtaposed manner, and a cover 70 which is attached to the connector housing 60 to cover the press-contacting portion 22 corresponding to the press-contacting blades 42.

The press-contacting terminal fitting 40 includes a terminal connecting portion 41 of a tubular shape formed at one end thereof, and a pair of parallel press-contacting blades 42 formed at other end thereof. The parallel press-contacting blades 42 press-contact the insulated conductor D which is extended in a direction perpendicular to a terminal fitting direction. A notch 44 for being press-contacted with the insulated conductor D is formed in a widthwise-central portion of each press-contacting blade 42, and extends in the press-contacting direction. The terminal connecting portion 41 and the pair of press-contacting blades 42 are interconnected by an interconnecting portion 43 of an L-shape.

The terminal connecting portions 41 of the press-contacting terminal fittings 40 are received in the connector housing 60 in such a juxtaposed manner that their press-contacting blades 42 are arranged in a staggered manner, that is, disposed alternately at upper and lower positions.

A plurality of terminal receiving chambers 61 for respectively receiving the terminal connecting portions 41 of the press-contacting terminal fittings 40 are formed in the connector housing 61 in a juxtaposed manner. The connector housing 61 is made of an insulative resin. Terminal insertion ports 61a each for the insertion of a mating terminal thereinto are formed in a front face (left side face in FIG. 4) of the connector housing.

A plurality of juxtaposed guide recesses 64U are formed in a rear end (left end in FIG. 3) of a top plate 60U of the connector housing 60, while a plurality of juxtaposed guide recesses 64L are formed in a rear end (left end in FIG. 3) of a bottom plate 60L of the connector housing, and theses recesses 64U and 64L guide and hold the insulated conductors D extending vertically. As shown in FIG. 3, partition walls 65 for separating the plurality of insulated conductors D from one another are formed at the rear end face of the connector housing 60, and are disposed between the row of upper guide recesses 64U and the row of lower guide recesses 64L, and extend vertically.

An elastically-deformable lock arm 66 is formed on an upper face of the top plate 60U of the connector housing 60, and when the press-contacting connector 50 is attached to a mating connector portion such for example as an electric box, this lock arm 66 prevents the connector 50 from being disengaged from the mating connector portion. Retaining projections 68 are formed respectively on outer faces of opposite side plates 67 of the connector housing 60, and when the cover 70 is attached to the connector housing, these retaining projections 68 retain the cover 70.

As shown in FIGS. 3 and 4, the cover 70 has a generally flat plate-like shape, and lock arms 71 are formed on and project respectively from right and left sides, respectively, of this cover. These lock arms 71 are retainingly engaged respectively with the retaining projections 68 of the connector housing 60, thereby preventing the cover 70 from being disengaged from the connector housing 60.

Guide ribs 51*a*, corresponding to the guide recesses 64U, are formed in an upper face of the cover 70 so as to guide the insulated conductors D rearwardly, while guide ribs 51*a*, corresponding to the guide recesses 64L, are formed in a lower face of the cover 70 so as to guide the insulated conductors D rearwardly. These guide ribs 51*a* extend in the forward-rearward direction. Pressing projections 72 are formed on an inner face of the cover 70 for respectively pressing the insulated conductors D in the press-contacting direction.

Next, the flat cable end-processing method of the invention will be described.

FIGS. 5A to 5D explanatory views showing the steps of the flat cable end-processing method, respectively, and FIG. 6 is a perspective view showing a condition in which the connector housing 60 of the press-contacting connector 50 is press-contacted with the insulated conductors D of the press-contacting portion 22.

Figure 5A:
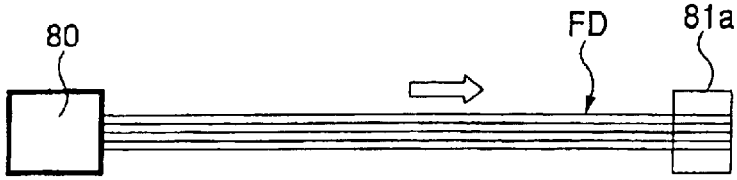
FIGS. 5A–5D are explanatory views showing the steps of a flat cable end-processing method.

As shown in FIG. 5A, first, the flat cable FD set in a wire supply machine 80 is fed into a predetermined length while the distal end of this flat cable FD is held by a wire holder 81*a*.

Figure 5B:
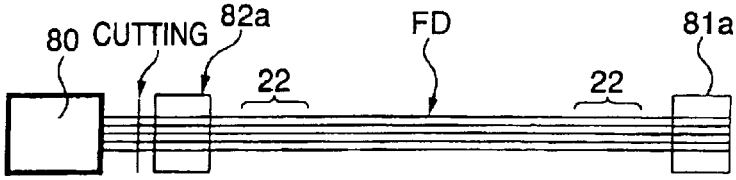

Then, the flat cable FD is held by a wire holder 82a located near the wire supply machine 80, and the flat cable FD is severed as shown in FIG. 5B. Press-contacting portions 22 are formed respectively at those portions of the flat cable disposed respectively at those sides of the wire holders 81*a* and 82*a* close to a central portion of the flat cable. Additionally, at each of these press-contacting portions 22, insulating interconnecting portions 20 are removed by cutting over a predetermined range in the longitudinal direction so that the distance between any two adjacent insulated conductors D can be adjusted in the direction of the width of the flat cable.

Figure 5C:
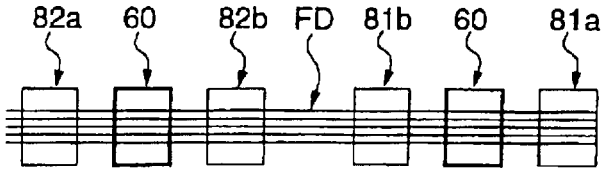

Then, as shown in FIG. 5C, wire holders 81*b* and 82*b* are located respectively at those sides of the two wire holders 81*a* and 82*a*, and are disposed close to the central portion of the flat cable FD, in such a manner that the press-contacting portion 22 is disposed between the wire holders 81*a* and 81*b* while the other press-contacting portion 22 is disposed between the wire holders 82*a* and 82*b* so that connector housings 60 can be press-contacted with the two press-contacting portions 22 of the flat cable FD, respectively. The wire holders 81*a* and 81*b* and wire holders 82*a* and 82*b* are located respectively at front and rear sides (spaced from each other in the longitudinal direction) of the corresponding press-contacting portion 22, and fixedly hold a corresponding distal end portion 21 and a corresponding central-side portion of the flat cable FD against movement, so that a predetermined tension is imparted to each press-contacting portion 22.

Figure 5D:
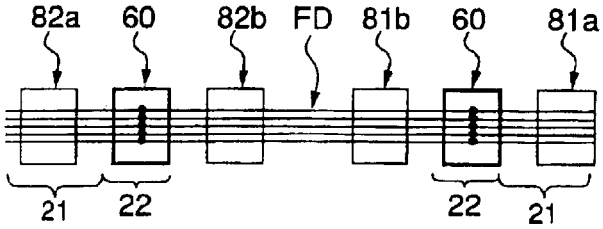

Then, each of the press-contacting portions 22 of the flat cable FD is press-contacted with press-contacting blades 42 of press-contacting terminal fittings 40 mounted in the corresponding connector housing 60, as shown in FIG. 5D.

At this point, the distal end portion 21 and central-side portion of the flat cable FD, disposed respectively at the front and rear sides (spaced from each other in the longitudinal direction) of the press-contacting portion 22, are fixedly held against movement, and also the distance between the adjacent insulated conductors D of the press-contacting portion 22 can be adjusted in the direction of the width. Thus, the insulated conductors D are accurately positioned in accordance with the highly-precise pitch of the press-contacting blades 42, and are positively press-contacted with these press-contacting blades as shown in FIG. 6.

Thereafter, the cover 70 is attached to the connector housing 60 to cover the press-contacting portion 22 for the press-contacting blades 42, so that the insulated conductors D are fixedly held between the cover 70 and the connector housing.

Figure 7:
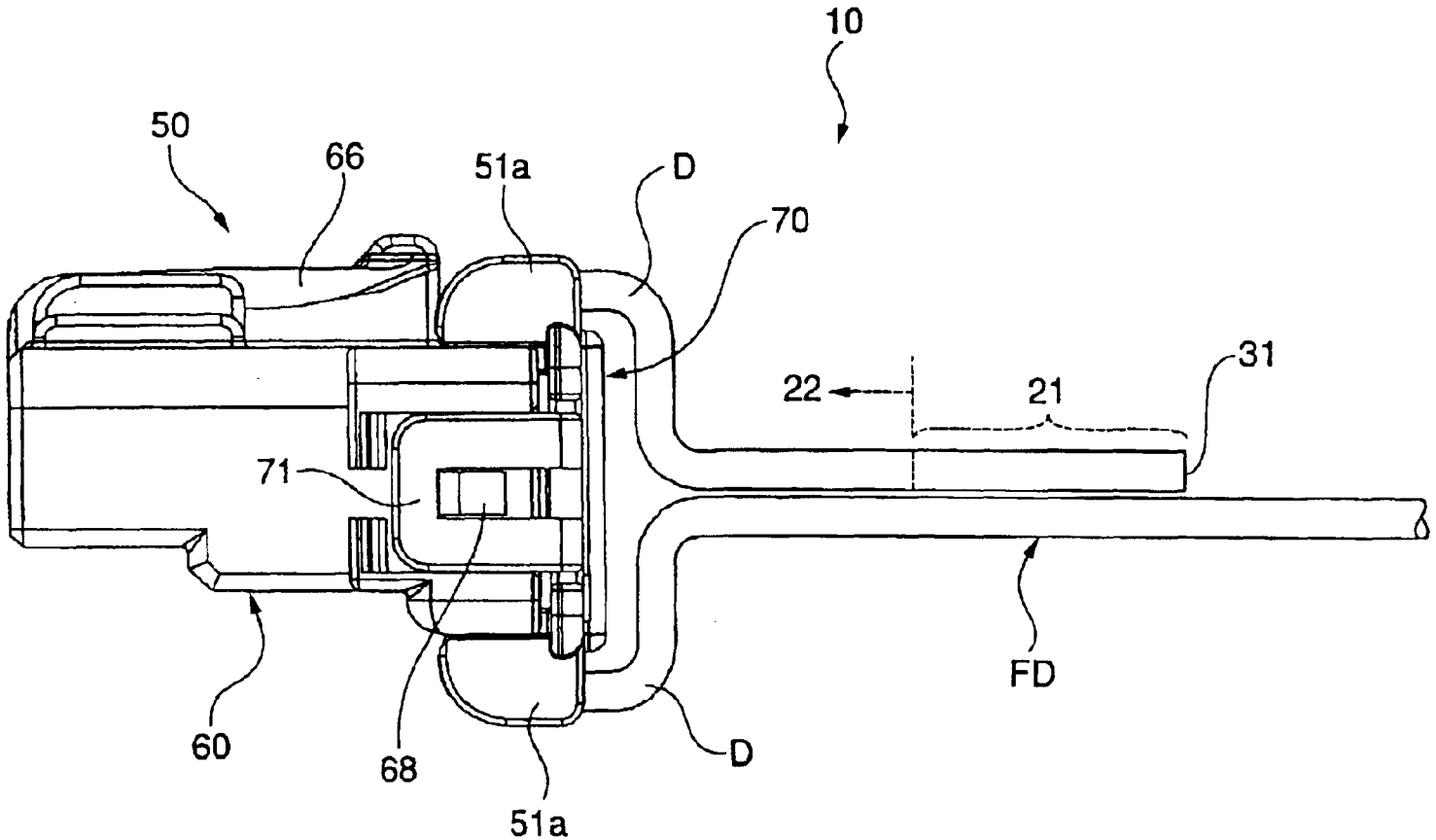
FIG. 7 is a side-elevational view showing a condition in which a cover is attached to the connector housing of FIG. 6, and a distal end portion of the flat cable is folded back.
Figure 8:
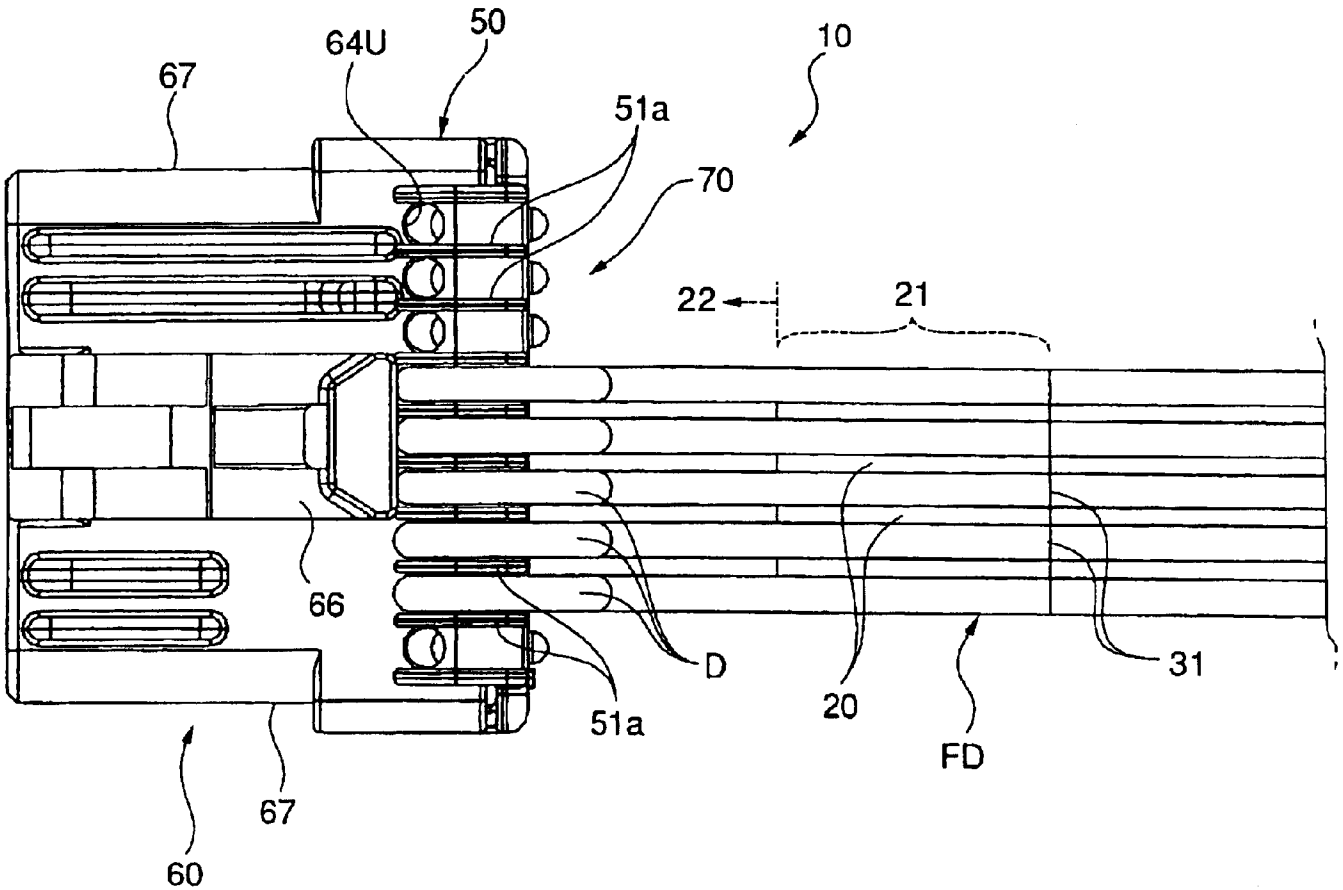
FIG. 8 is a plan view showing the condition in which the cover is attached to the connector housing of FIG. 6, and the distal end portion of the flat cable is folded back.
Figure 9:
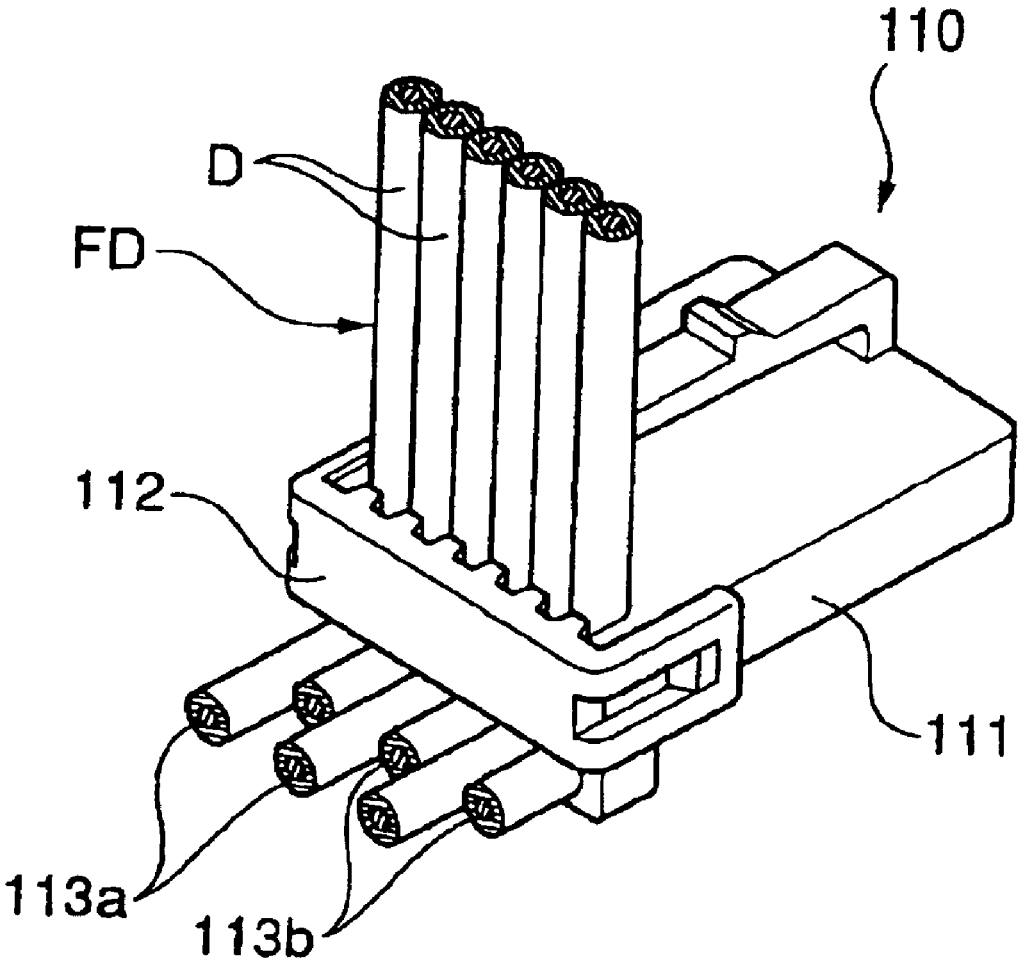
FIG. 9 is a perspective view showing a conventional flat cable end-processing structure.

Further, the distal end portion 21 (which is an extra portion) is folded back to be superposed on the central-side portion (right-side portion in FIG. 7) of the flat cable FD in such a manner that the end portion of the flat cable FD is extended along the outer face (upper and lower faces in FIG. 7) of the cover 70 as shown in FIGS. 7 and 8. In this condition, a binding member 30 such as an insulating tape is wound on the superposed portions to enclose end faces 31 of the distal end portion 21 to insulate these end faces from the exterior as shown in FIGS. 1 and 2.

As described above, the flat cable FD is held by the wire holder 81*a* from the flat cable FD is fed from the wire supply machine 80 until the press-contacting portions 22 are press-contacted with the connector housings 60, respectively. After the press-contacting operation is completed, each distal end portions 21 (which is the unnecessary extra portion) is folded back to be superposed on the central-side portion of the flat cable FD, and the superposed portions are bound by the binding member 30, so that the distal end portion 21 is prevented from fluttering.

The end faces 31 of the distal end portion 21 are covered with the wound binding member 30 so as to be insulated from the exterior. Further, the insulated conductors D at the distal end portion 21 are held at the predetermined intervals by the insulating interconnecting portions 20. Therefore, the end faces 31 of the adjacent conductors S will not be accidentally moved toward each other, and therefore the current leakage and the short-circuiting are positively prevented.

Additionally, the distal end portion 21 (which is the extra portion) is folded back to be superposed on the central-side portion of the flat cable FD in such a manner that the end portion of the flat cable FD is extended along the outer face of the cover 70, and then these superposed portions are bound by the binding member 30. In this configuration, the end portion of the flat cable FD is fixed along the outer face of the cover 70 in intimately-contacted relation thereto. Thus, even when a pulling force acts on the flat cable FD, press-contacted parts of the press-contacting portion for the press-contacting blades 42 are less liable to be affected by this force.

In this embodiment, the plurality of guide ribs 51*a* for arranging the insulated conductors D, which are held in intimate contact with the outer face of the cover 70 in a row are formed on the cover 70, and extend in the forward-rearward direction. Therefore, even when a pulling force acts on the flat cable FD in the direction of the width of the connector (that is, in the upward-downward direction in FIG. 7), the insulated conductors D will not be displaced in the direction of the width, and the press-contacted portions are prevented from being affected by this pulling force.

The flat cable end-processing structure of the invention, as well as the end processing method of the invention, is not limited to the construction of the above embodiment, and various forms can be adopted on the basis of the subject matter of the invention.

For example, in the above embodiment, although each press-contacting terminal fitting 40 provided with the press-contacting blades 42 has the L-shaped interconnecting portion 43 provided between the terminal connecting portion 41 and the pair of press-contacting blades 42, known press-contacting terminal fittings, that have a straight interconnecting portion, may be used. Further, the connector housing, the cover and so on are not limited to the illustrated constructions in the above embodiment.

What is claimed is:

1. An end-processing structure of a flat cable, comprising:

a flat cable, including:

a plurality of sheathed conductors which are arranged in parallel, each conductor being covered with an insulative sheath; and a plurality of connecting portions, each interconnecting the plurality of sheathed conductors, wherein the flat cable has an interconnecting part in which the sheathed conductors are interconnected with the connecting portions, and a press-contacting part in which the sheathed conductors are separated from each other;

a connector housing;

a plurality of pressure terminal fittings, respectively having press-contacting blades, and mounted in the connector housing; and a cover, attached to the connector housing to cover the press-contacting part of the flat cable which is press contacted with the press-contacting blades, wherein a first interconnecting part extended from the press-contacting part and having end faces of a distal end portion of the flat cable is folded back from a first side of the cover along an outer face of the cover;

wherein a second interconnecting part extended from the press-contacting part is folded back from a second side of the cover along the outer face of the cover;

wherein the first interconnecting part of the flat cable is superposed on the second interconnecting part of the flat cable; and wherein a superposed portion of the first and second interconnecting parts are bound so as to surround the end faces of the distal end portion to insulate the end faces from an exterior by a binding member.

2. The flat cable end-processing structure as set forth in claim 1, wherein the cover has a pressing member which presses the press-contacting part of the flat cable press-contacted with the press-contacting blades in a state that the cover is attached to the connector housing.

3. The flat cable end-processing structure as set forth in claim 1, wherein a guiding member is formed on the outer face of the cover so as to guide the flat cable which is folded back from the cover along the outer face of the cover.

4. A method of end-processing of a flat cable, comprising the steps of:

providing a flat cable which includes a plurality of sheathed conductors which are arranged in parallel, each conductor being covered with an insulative sheath, and the sheathed conductors being interconnected with each other by a plurality of connecting portions;

providing a connector housing;

providing a plurality of pressure terminal fittings, respectively having press-contacting blades, and mounted in the connector housing;

providing a cover;

cutting the connecting portions of the flat cable so as to form a press-contacting part in which the sheathed conductors are separated from each other;

press-contacting the press-contacting part of the flat cable to the press-contacting blades;

attaching the cover to the connector housing to cover the press-contacting part of the flat cable which is press contacted with the press-contacting blades;

folding back a first interconnecting part of the flat cable extended from the press-contacting part and having end faces of a distal end portion of the flat cable from a first side of the cover along an outer face of the cover;

folding back a second interconnecting part of the flat cable extended from the press-contacting part from a second side of the cover along the outer face of the cover;

superposing the first interconnecting part of the flat cable on the second interconnecting part of the flat cable; and binding a superposed portion of the flat cable so as to surround the end faces of the distal end portion to insulate the end faces from an exterior by a binding member.

* * * * *